US011777252B2

(12) United States Patent
Demaratos et al.

(10) Patent No.: US 11,777,252 B2
(45) Date of Patent: Oct. 3, 2023

(54) MANUFACTURING METHOD FOR ASSEMBLING AT LEAST A HIGH VOLTAGE VERTICAL DISK FERRULE

(71) Applicant: J.S.T. CORPORATION, Farmington Hills, MI (US)

(72) Inventors: David Demaratos, Wixom, MI (US); Joshua Taylor, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 17/366,987

(22) Filed: Jul. 2, 2021

(65) Prior Publication Data

US 2022/0021153 A1 Jan. 20, 2022

Related U.S. Application Data

(63) Continuation of application No. 17/101,997, filed on Nov. 23, 2020, now Pat. No. 11,670,892.
(Continued)

(51) Int. Cl.
*H01R 13/53* (2006.01)
*H01R 13/6591* (2011.01)
(Continued)

(52) U.S. Cl.
CPC ..... *H01R 13/53* (2013.01); *H01R 13/405* (2013.01); *H01R 13/6583* (2013.01); *H01R 13/65912* (2020.08); *H01R 13/65914* (2020.08)

(58) Field of Classification Search
CPC ..... H01R 4/029; H01R 13/405; H01R 13/53; H01R 13/6592; H01R 13/65912; H01R 13/65914; H01R 13/6583
See application file for complete search history.

(56) References Cited

U.S. PATENT DOCUMENTS 5,401,177 A * 3/1995 Dutton ..... H01R 13/6593 439/98
9,432,730 B2 * 8/2016 Chen ..... H04N 21/4415
(Continued)

FOREIGN PATENT DOCUMENTS

WO 2006/126381 A1 11/2006

OTHER PUBLICATIONS

International Search Report for International Application No. PCT/US2021/041607 dated Oct. 20, 2021 (3 sheets).

*Primary Examiner* — Oscar C Jimenez
(74) *Attorney, Agent, or Firm* — Kratz, Quintos & Hanson, LLP

(57) ABSTRACT

A manufacturing method for assembling a high voltage vertical disk ferrule, the ferrule being stamped and having a vertical disk-like structure, which is not necessarily round or does not necessarily have any roundness. The high voltage disk ferrule has an opening residing and traveling over the wire core and/or a wire braided shield, to which an end portion of the wire braided shield is affixed thereto the ferrule, or between two ferrules, such that a portion of the wire braided shield is flared and substantially perpendicular to the direction along which the wire core extends. The high voltage vertical disk ferrule slides over the core insulation, towards the outer insulation when the wire is pushed. The end portion/flared portion of the braided shield and the high voltage vertical disk ferrule, or the end portion/flared portion of the braided shield between at least two high voltage vertical disk ferrules are soldered, welded, or brazed together. The wire braided shield develops a natural spring force against the ferrule, and causes it to be accordioned, pleated, or folded against itself, and therefore pushes the vertical disk ferrule forward.

18 Claims, 4 Drawing Sheets

Related U.S. Application Data

(60) Provisional application No. 63/051,517, filed on Jul. 14, 2020.

(51) Int. Cl.
*H01R 13/405* (2006.01)
*H01R 13/6583* (2011.01)

(56) References Cited

U.S. PATENT DOCUMENTS

| | | | | |
|---|---|---|---|---|
| 9,461,414 | B2 * | 10/2016 | Yanagihara | H05K 9/0018 |
| 10,193,281 | B1 * | 1/2019 | Rossman | H01R 13/6584 |
| 2015/0099397 | A1 | 4/2015 | Listing | |
| 2016/0205815 | A1 * | 7/2016 | Mori | H01R 43/18 174/360 |
| 2018/0151996 | A1 | 5/2018 | Matsumoto | |

* cited by examiner

MANUFACTURING METHOD FOR ASSEMBLING AT LEAST A HIGH VOLTAGE VERTICAL DISK FERRULE

CROSS-REFERENCE TO RELATED APPLICATIONS

This is a Continuation of U.S. patent application Ser. No. 17/101,997 filed on Nov. 23, 2020, which claims priority to U.S. Provisional Patent Application No. 63/051,517 filed Jul. 14, 2020, which is hereby incorporated herein by reference in its entirety.

BACKGROUND OF THE INVENTION

The present invention generally relates to a manufacturing method for electrical connectors, ferrules, and wire/cable shielding interfaces, which utilizes grounding or electromagnetic interference (EMI) suppression and are useful in automotive applications.

SUMMARY OF THE INVENTION

This invention is directed to a manufacturing method for assembling at least a high voltage vertical disk ferrule. The manufacturing method for assembling the vertical disk ferrule of this invention slides over the core insulation, once affixed to the wire braided shield, towards the point or location the outer insulation is cut (vertical surface of the outer insulation). This assembling method includes a step of pushing back the wire braided shield and allowing for the wire braided shield to develop a natural spring force against the vertical disk ferrule, and for allowing the wire braided shield to become in the condition or state where it has accordioned, pleated, or folded against itself, and therefore pushing back against the direction the ferrule has traveled along the wire core when the wire is being pushed, so as to push the vertical disk ferrule forward (towards the cut end of the wire or terminal attached thereto). This force will allow the vertical disk ferrule or wire braided shield if therebetween, to remain in contact with the grounding structure of the connector when in use or when as a single ferrule, pushes the wire braded shield against the housing or ferrule when in use.

The manufacturing method of this invention solders, welds (e.g., resistive, spot, ultrasonic, or the like), brazes, or joins (by mechanical or electrical means) a flared portion of the wire braided shield to at least one of the high voltage vertical disk ferrule. A benefit of the manufacturing method of this invention is the ability to provide for a high voltage disk ferrule, which is a disk-like structure, to take on any shape to which it can be stamped, will also allow for it to provide complete or near complete electromagnetic interference (EMI) coverage in use with a corresponding connector assembly or housing, which may require a specific shape, and which will further allow for little or no escape path for the EMI by covering the aperture or hole through which the wire or terminal is placed into when in use with such corresponding housing in which the wire or terminal is inserted into, unlike in conventional ferrules and conventional stamped shields which may allow for EMI escape.

A further benefit of the manufacturing method of this invention is the ability to also provide for an adequate clearance between the wire core or terminal (power circuit), and the wire braid shield or ferrule (grounding circuit), while also limiting the likelihood of contact between the power circuit and grounding circuit in the process by also limiting the likelihood of stray strands of the wire braid shield from contacting the power circuit.

DETAILED DESCRIPTION OF THE PREFERRED EMBODIMENTS

Figure 1:
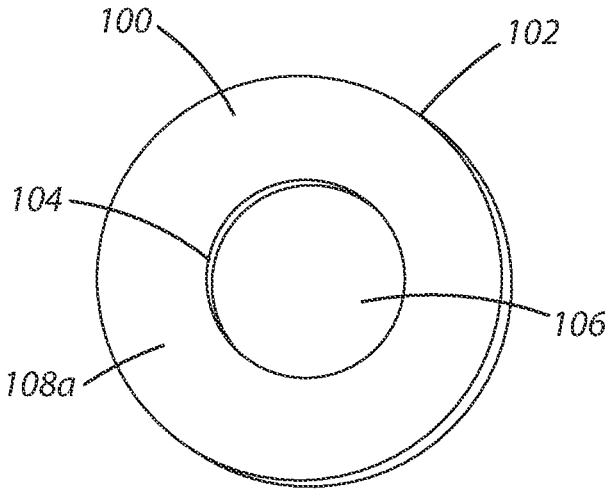
FIG. 1 is a front elevational view of the high voltage vertical disk ferrule used in the manufacturing method of the present invention.

Shown in FIG. 1 is a high voltage vertical disk ferrule 100. The vertical disk ferrule 100 may be made of any electrically conducting material (such as, but not limited to, copper, tin plated copper, steel, brass alloy, bronze or the like, or any like-kind of conductive metal known in metallurgy). The vertical disk ferrule 100 is comprised of an outer edge 102, an inner edge 104, defining an opening or aperture 106, and additionally a front face 108*a* which is flat, and a back face 108*b* which is also flat. As more precisely shown in FIG. 2, the outer edge 102 and the front face 108*a* meet perpendicularly, and similarly, the outer edge 102 and the rear face 108*b* meet perpendicularly. Furthermore, the inner edge 104 and the front face 108*a* meet perpendicularly, and similarly, the inner edge 104 and the rear face 108*b* meet perpendicularly, and similarly, the inner edge 104 and the rear face 108*b* meet perpendicularly.

Figure 7A:
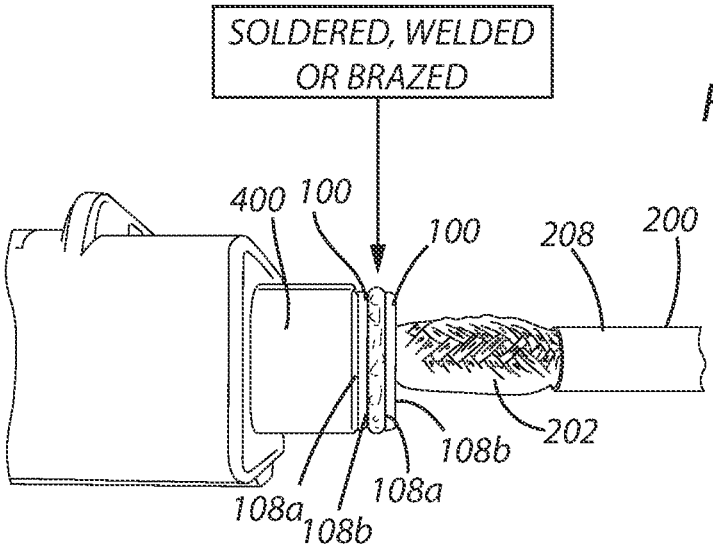
FIG. 7A is a side elevational view of the high voltage vertical disk ferrule using two high voltage vertical disk ferrules and fully soldered, welded, or brazed together with a wire, in the manufacturing method of this invention, the wire being inserted into a corresponding connector housing.
Figure 7B:
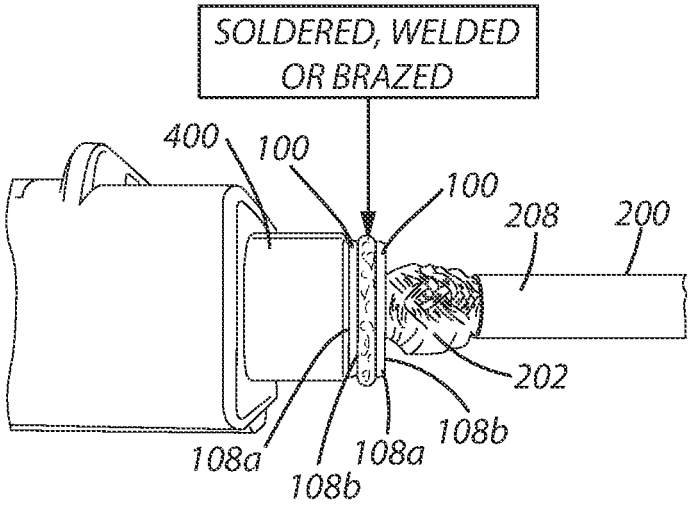
FIG. 7B is a side elevational view of the high voltage vertical disk ferrule using two high voltage vertical disk ferrules and fully soldered, welded, or brazed together with the wire, in the manufacturing method of this invention, the wire being further inserted into a corresponding connector housing.
Figure 7C:
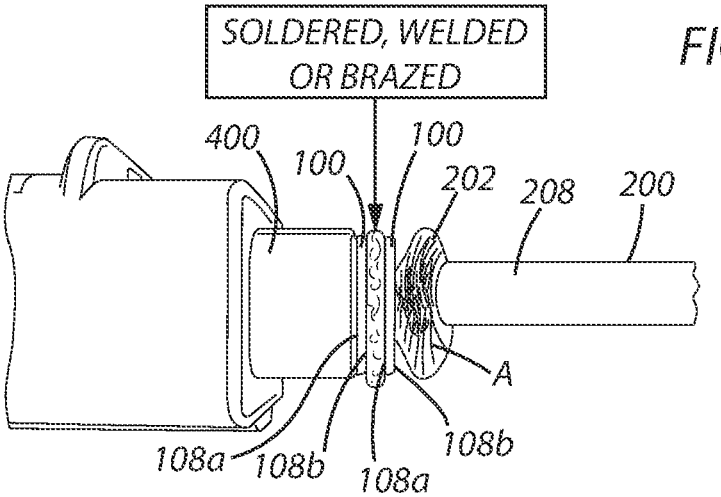
FIG. 7C is a side elevational view of the high voltage vertical disk ferrule using two high voltage vertical disk ferrules and fully soldered, welded, or brazed with a wire, in the manufacturing method of this invention, the wire being fully inserted into a corresponding connector housing.

Further, the vertical disk ferrule 100 is shown in FIG. 1 as a vertical disk-like structure, being a round, circular shape, although, the form is not limited thereto. The disk-like structure is primarily made of the vertical flat surfaces of the front face 108*a* and back face 108*b* and the perimeter, edge, or vertical shape constraints of the outer edge 102 is not necessarily formed to become round or does not necessarily have any roundness and is further able to take on any shape to which it can be stamped. For example, the shape of the vertical disk ferrule 100 could take the form of an oval, ellipse or any other shape allowable by stamping means which define the outer edge 102. Preferably, the shape of the vertical disk ferrule 100 will provide complete or near complete coverage over a corresponding hole or aperture (not shown) in a connector housing into which a related wire 200 (see, e.g., FIGS. 7A-7C) is attached and is required to pass through which is being used with the vertical disk ferrule 100. Thus, the shape of the vertical disk ferrule 100 will allow for it to provide complete or substantial electromagnetic interference (EMI) suppression or coverage when in use with a corresponding connector housing 400 (see, e.g., FIGS. 7A-7C). The housing 400 itself may require the vertical disk ferrule 100 to be a specific shape to fit into a recess or cavity thereof (not shown).

Figure 2:
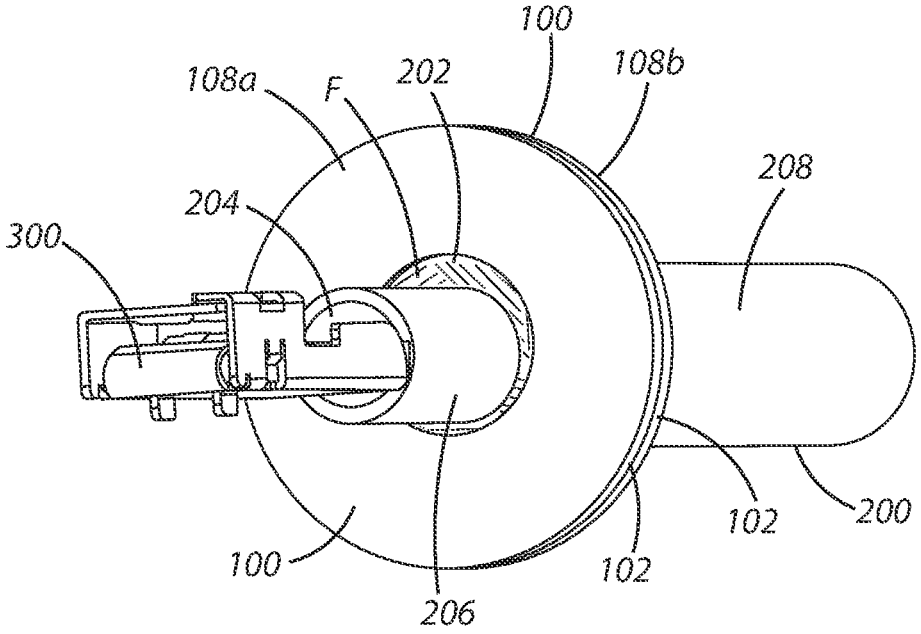
FIG. 2 is a perspective view of the high voltage vertical disk ferrule using two high voltage vertical disk ferrules, fully assembled with a wire, in the manufacturing method of the present invention.

As illustrated in FIG. 1 or FIG. 2, is the circular shaped vertical disk ferrule 100, having its front face 108*a* and its back face 108*b* radiate outward, vertically, from its opening 106 and the respective wire 200 which is inserted and accommodated through the opening 106. The wire is comprised of a wire core portion 204, wire core insulation 206, wire braided shield 202, and outer wire insulation 208. As previously discussed, the front face 108*a* and back face 108*b* of the vertical disk ferrule 100 are preferably generally perpendicular to the axial direction of the wire 200. The diameter, or size of the front face 108*a* and the back face 108*b* are such that the vertical disk ferrule 100 is large enough to cover a hole (not shown) in a respective housing 400 (see FIGS. 7A-7C)), wherein the hole is large enough to accommodate a terminal and a respective portion of the wire core 204 and or wire core insulation 206. Therefore, the size of the front face 108*a* and the back face 108*b* of the high voltage vertical disk ferrule 100 is not limited, and their respective sizes would however need to be such that they are not less than the size of the outer insulation 208 of the wire 200, so that the vertical disk ferrule 100 may have an inner edge 104 defining an opening 106 for the vertical disk ferrule 100, which is adequately sized for proper use with the respective wire 200 size, while the vertical disk ferrule 100 has adequate surface on the front face 108*a* and the back face 108*b* for proper grounding with a grounding feature and properly functions when in use, the wire 200 remaining flexible behind the ferrule. The opening 106 of the vertical disk ferrule 100 is also of a size that allows the vertical disk ferrule 100 to move freely over a wire braided shield 202 of a wire 200, if required, as will be discussed later.

The vertical disk ferrule 100 contacts with respective grounding elements in a respective housing 400 (see, FIGS. 7A-7C) at its front vertical face 108*a* or in combination with its front vertical face 108*a* and wire braided shield 202 when used as a single ferrule 100 with the flared portion F of the wire braided shield 202 therebetween. The grounding elements in a respective housing 400 may be for example, plated surfaces, a traditional stamped shield, foil lined surfaces, or other conductive materials utilized within, on, or by the housing 400 for grounding purposes. The outer edge 102 of the vertical disk ferrule 100 may also make contact with the grounding elements of a respective housing 400, if so chosen.

The thickness of the vertical disk ferrule 100, in an axial direction, is defined by the length of the outer edge 102, preferably no more than 1 mm (however, the size and/or length thereof is not limited); and the preferred thickness of the vertical disk ferrule 100 in the axial direction will be kept thin enough to provide for less required space in a respective connector housing compared to that in a conventional crimped ferrule, being thinner or shorter than a traditional crimped ferrule, and also allowing adequate take-up of the wire 200, as will be discussed further below. The thickness of the vertical disk ferrule 100 is further preferably accommodates the vertical disk ferrule 100 within a recess in a respective connector housing 400 such that the vertical disk ferrule 100 resides within a portion of a respective connector housing 400 if needed, and thereby providing a much shorter design for the connector housing 400 than traditional ferrules required in the manufacturing method of assembling. The vertical disk ferrule 100 may also be accommodated on the exterior of a respective connector housing 400 by substantially abutting a surface or side thereof the connector housing 400 (see, FIGS. 7A-7C).

Figure 3:
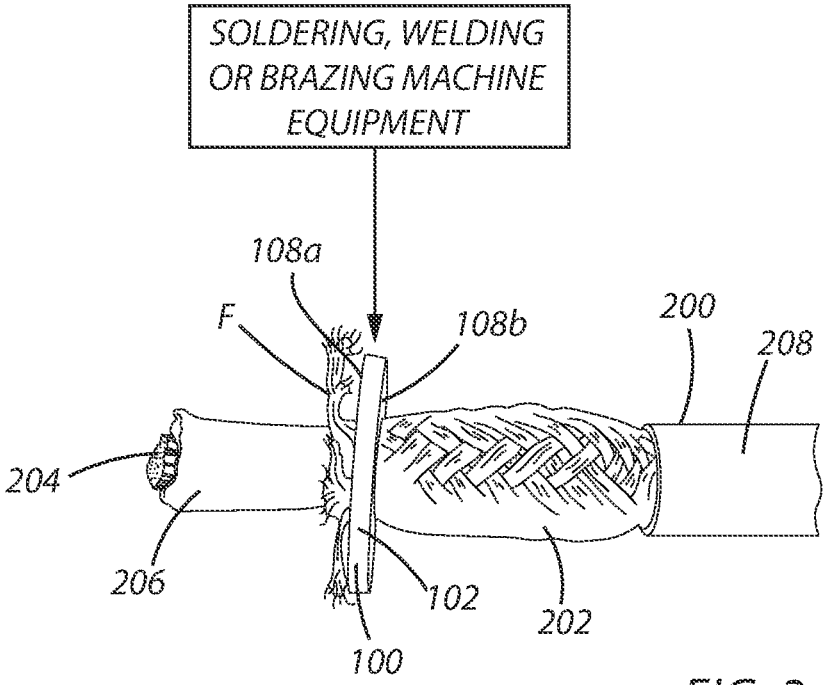
FIG. 3 is a side elevational view of the high voltage vertical disk ferrule assembled, in the manufacturing method of this invention, with a wire and flared portion of the wire braided shield affixed on the front face of the high voltage vertical disk ferrule, shown ready to be soldered, welded, or brazed.

As illustrated in FIG. 3, the vertical disk ferrule 100 is placed along the wire braided shield 202 of the wire 200. Here, as previously discussed, both the front face 108*a* and rear face 108*b* of the vertical disk ferrule 100 are preferably substantially perpendicular to the axial direction of the wire 200. The wire braided shield portion 202 can therefore be affixed to the front face 108*a* by being flared outward forming a flared portion F radiating away from a core insulation portion 206, substantially perpendicular to the lengthwise direction of the wire 200.

Figure 4:
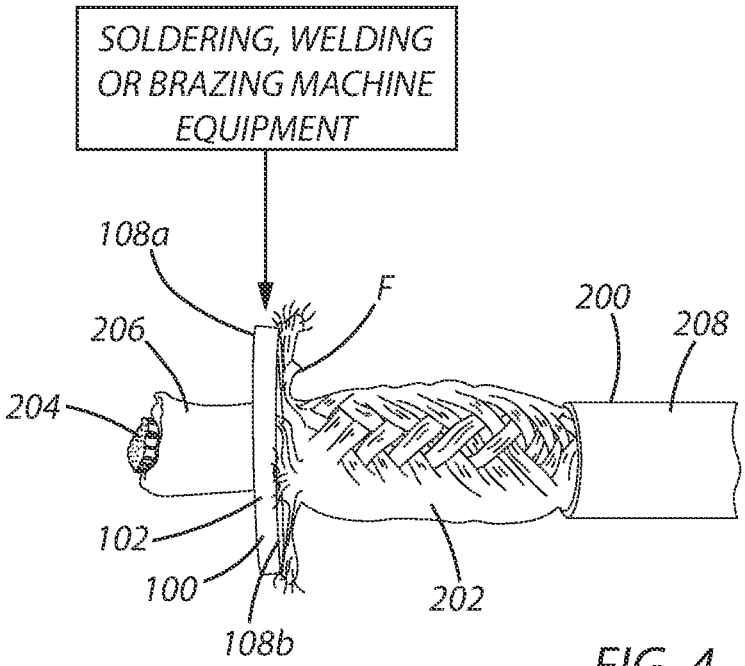
FIG. 4 is a side elevational view of the high voltage vertical disk ferrule assembled, in the manufacturing method of this invention, with a wire and flared portion of the wire braided shield affixed on the rear face of the high voltage vertical disk ferrule, shown ready to be soldered, welded, or brazed.

Likewise, in FIG. 4, the flared portion F of the wire braided shield portion 202 can also be affixed to the rear face 108*b* of the vertical disk ferrule 100. Both methods allow the wire braided shield portion 202 of the wire 200 to be secured in a manner that the wire shield 202 is in conductive electrical contact with the front 108*a* or rear 108*b* face of the vertical disk ferrule 100. Here, advantageously, the wire braided shield 202 does not require further secondary cutting once the vertical disk ferrule 100 is in a position where the wire braided shield 202 does not extend past, radially, away from the front 108*a* or rear 108*b* face of the vertical disk ferrule 100, whether using a single vertical disk ferrule 100 or using two vertical disk ferrules 100.

In the manufacturing method of assembling of this invention where the wire 200 is pushed into and through the vertical disk ferrule 100, this manufacturing method pushes back the wire braided shield 202 and allows for the wire braided shield 202 to develop a natural spring force against the vertical disk ferrule 100 (rearmost vertical disk ferrule 100 if two vertical disk ferrules 100 are used), and the wire braided shield 202 becomes in the condition or state where it has accordioned, pleated, or folded against itself (see, FIG. 7C), and therefore pushes back against the direction the vertical disk ferrule 100 has traveled along the wire core 204 when the wire 200 is being pushed, so as to push the vertical disk ferrule 100 forward (towards the cut end of the wire 200 attached thereto). This force will allow the vertical disk ferrule 100 and/or wire braided shield 202, if there in between the vertical disk ferrule 100 and the connector housing 400, to remain in contact with the grounding structures of the connector housing 400. If a single vertical disk ferrule 100 is used, the force pushes the vertical disk ferrule 100 against the wire braded shield 202, which abuts against the grounding feature or housing 400.

Figure 5:
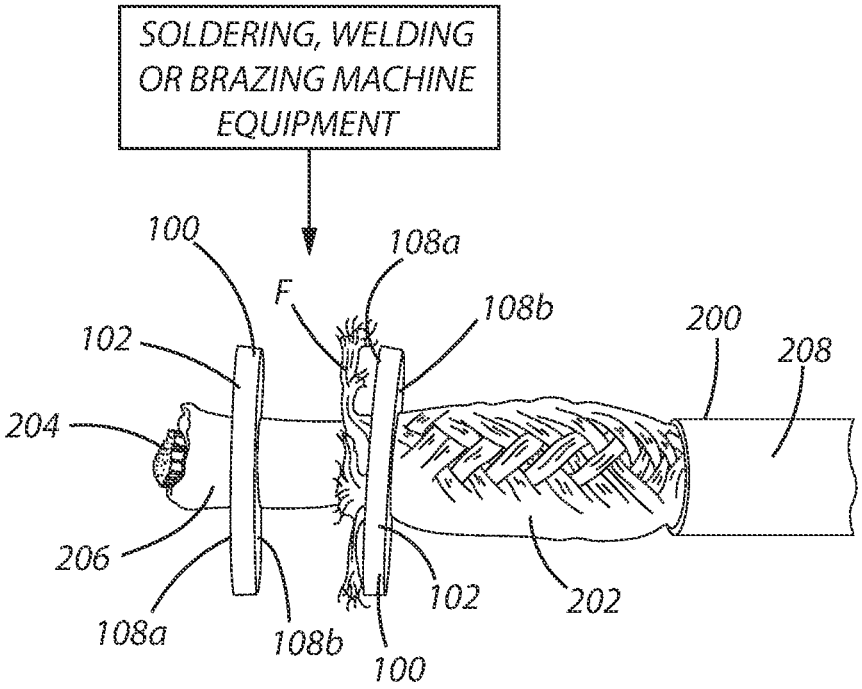
FIG. 5 is a side elevational view of the high voltage vertical disk ferrule using two high voltage vertical disk ferrules to be assembled, in the manufacturing method of this invention, with a wire, and thereafter soldered, welded, and brazed.
Figure 6:
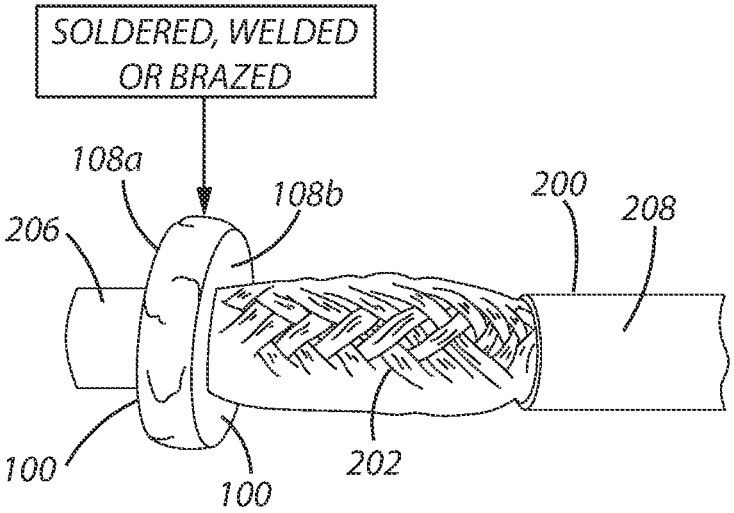
FIG. 6 is a side elevational view of the high voltage vertical disk ferrule using two high voltage vertical disk ferrules soldered, welded, or brazed together and fully assembled, in the manufacturing method of this invention, with a wire.

Shown in FIG. 5 or FIG. 6 is the preferable use of two vertical disk ferrules 100 for use in the manufacturing method of assembling of this invention. The use of two vertical disk ferrules 100, a first vertical disk ferrule 100*a* and a second vertical disk ferrule 100*b*, provides the ability to sandwich the wire braided shield 202 of wire 200 in between the front face 108*a* of the first vertical disk ferrule 100*a* and the rear face 108*b* of the second vertical disk ferrule 100*b*. The first vertical disk ferrule 100*a*, as shown in FIG. 5, is placed over the wire braided shield portion 202, such that the then flared portion F of the wire braided shield 202 is then contacted by the front face 108*a* of the first vertical disk ferrule 100*a* and then the rear face 108*b* of the second vertical disk ferrule 100*b* makes contact with the flared portion F as it is inserted over, and eventually residing over, the wire core insulation 206, preferably not making contact with the wire core 204 when in use. The above-discussed manufacturing method of assembling provides adequate contact between the flared portion F of the wire braided shield 202 and the first vertical disk ferrule 100*a* and second vertical disk ferrule 100*b*, and further provides an adequate continuity to the wire braided shield 202 from both vertical disk ferrules 100 when in use. Soldering, welding, or brazing, or other mechanical, or electro-mechanical means may be used to further stabilize or promote the sandwiching or insertion of the wire braided shield 202 flared portion F, and to secure the integrity and long life of these joined parts.

When using two vertical disk ferrule 100, it may further or optimally be desired to securely affix the two vertical disk ferrule 100 together in order to retain and keep the wire braided shield 202 inserted or sandwiched therebetween, as discussed above. It is preferred that soldering, welding, or brazing, or mechanical, or electro-mechanical means are used to connect the two vertical disk ferrule 100 for adequate operation of the two vertical disk ferrules 100. For example, solder, weld (resistive, spot, or ultrasonic), or braze, or mechanical or electro-mechanical methods (see, FIG. 6) that can be used to connect the respective metals which comprise the two vertical disk ferrules 100. Also, a mechanical bond using a press fit or snap fit may be used. As shown in FIG. 6, a solder, weld (resistive, spot, or ultrasonic) has been applied in the manufacturing method for assembling, which keeps the first vertical disk ferrule 100*a* and second vertical disk ferrule 100*b* affixed together and the wire braided shield 202 secured therebetween. The manufacturing method of assembling or securing the two vertical disk ferrules 100 together provides and promotes an adequate conductive and/or physical substrate to connect the second vertical disk ferrule 100*b* to the first vertical disk ferrule 100*a*, and therefore assures the conductive connection and contact of the two vertical disk ferrules 100 to the wire braided shield 202 when or if the second vertical disk ferrule 100*b* makes contact with a grounding structure in a corresponding housing 400. Additionally, when a single vertical disk ferrule 100 is used, the wire braided shield 202 and vertical disk ferrule 100 may be soldered, welded, or brazed together to ensure they are fixed and secured in combination (soldered, welded, or brazed) either on the front face 180*a* or back face 108*b*, and that their movement together as a unit is synchronized (see, FIGS. 7A-7C).

The manufacturing method of assembling of a vertical disk ferrule 100 of this invention also increases the electrical clearance when in operation. By allowing the ferrule 100 and wire braided shield 202 (grounding circuit) to reside further away from the terminal 300 or wire core 204 (power circuit) as a result of the travel distance of the wire into the connector housing 400, and extension of the wire core 204 away from the vertical disk ferrule 100, the electrical clearance is increased from those two components, and thus in comparison to a conventional manufacturing method of assembling, which has a conventional ferrule closer to the attached terminal.

The manufacturing method of assembling of a vertical disk ferrule 100 of this invention also eliminates the possibility of stray strands from the braided shield 202 (ground circuit) from contacting the power circuit (wire core 204) during the operation thereof. The flared portion F of the wire braided shield 202 is substantially perpendicular and "pulled back" and away from the wire core insulation 208 and wire core 204 when used with the vertical disk ferrule 100, and as explained previously, any stray strands of the wire braided shield 202 will advantageously not be in proximity to the power circuit when the high voltage vertical disk ferrule 100 is in use.

Although the foregoing descriptions are directed to preferred embodiments in the manufacturing method for assembling at least the vertical disk ferrule of this invention, it is noted that other variations and modifications will be apparent to those skilled in the art, and may be made without departing from the spirit or scope of the invention. Moreover, the manufacturing method for assembling at least the vertical disk ferrule of this invention in connection with one embodiment of the invention may be used in conjunction with other embodiments, even if not explicitly state above.

We claim:

1. A manufacturing method for assembling a high voltage vertical disk ferrule and a wire, comprising the steps of:

inserting a ferrule over a wire shield of the wire;

pushing an end portion of the wire shield against said ferrule into a flared end portion, said flared end portion extending substantially perpendicular to a direction along which said ferrule is inserted over said wire shield of said wire;

allowing for the formation of a bunched or an accordion in a portion of said wire shield of the wire substantially located between said vertical disk ferrule and an outer insulation of said wire; and one of soldering, welding, and brazing said flared end portion of said wire shield and said ferrule together to form a soldered, welded, or brazed portion.

2. The manufacturing method for assembling said high voltage vertical disk ferrule and said wire according to claim 1, wherein said step of inserting said ferrule over said wire shield of said wire includes the step of positioning said ferrule substantially perpendicular to said wire.

3. The manufacturing method for assembling said high voltage vertical disk ferrule and said wire according to claim 1, wherein said step of inserting said ferrule includes one of:

a step of pushing said ferrule against an end portion of said wire shield, and a step of pushing said end portion of said wire shield against said ferrule.

4. The manufacturing method for assembling said high voltage disk ferrule and said wire according to claim 1, wherein said step of inserting at least one high voltage vertical disk ferrule includes the steps of:

inserting a first high voltage vertical disk ferrule over said wire shield of said wire;

pushing said end portion of said wire shield against said first high voltage vertical disk ferrule or pushing said first high voltage vertical disk ferrule against said end portion of said wire shield;

inserting a second high voltage vertical disk ferrule over a wire core insulation of said wire;

pushing said second high voltage vertical disk ferrule against said end portion of said wire shield; and one of soldering, welding, and brazing said first high voltage vertical disk ferrule and said second high voltage vertical disk ferrule together to form a soldered, welded, or brazed portion.

5. The manufacturing method for assembling said high voltage vertical disk ferrule and said wire according to claim 4, further comprising the steps of sandwiching a flared portion of said wire shield of said wire between said first and second high voltage vertical disk ferrules, then soldering, welding, or brazing said first high voltage vertical disk ferrule, said second high voltage vertical disk ferrule, and said flared portion of said wire shield together to form a soldered, welded, or brazed portion.

6. The manufacturing method for assembling said high voltage vertical disk ferrule and said wire according to claim 5, wherein said step soldering, welding, or brazing said first high voltage vertical disk ferrule, said second high voltage vertical disk ferrule, and said end portion or said flared portion of said wire shield together is performed by a mechanical or electro-mechanical machine equipment.

7. The manufacturing method for assembling said high voltage vertical disk ferrule and said wire according to claim 6, wherein said step of soldering, welding, or brazing includes the step of resistive welding said first high voltage vertical disk ferrule, said second high voltage vertical disk ferrule, and said end portion or said flared portion of said wire shield together.

8. The manufacturing method for assembling said high voltage vertical disk ferrule and said wire according to claim 6, wherein said step of soldering, welding, or brazing includes the step of spot welding said first high voltage vertical disk ferrule, said second high voltage vertical disk ferrule, and said flared portion of said wire shield together.

9. The manufacturing method for assembling said high voltage vertical disk ferrule and said wire according to claim 6, wherein said step of soldering, welding, or brazing includes the step of ultrasonic welding said first high voltage vertical disk ferrule, said second high voltage vertical disk ferrule, and said flared portion of said wire shield together.

10. The manufacturing method for assembling said high voltage vertical disk ferrule and said wire according to claim 1, wherein said step soldering, welding, or brazing said end portion of said wire shield and said ferrule together is performed by a mechanical or electro-mechanical machine equipment.

11. The manufacturing method for assembling said high voltage vertical disk ferrule and said wire according to claim 10, wherein said step of soldering, or brazing includes the step of resistive welding said end portion of said wire shield and said high voltage vertical disk ferrule together.

12. The manufacturing method for assembling said high voltage vertical disk ferrule and said wire according to claim 10, wherein said step of soldering, welding, or brazing includes the step of spot welding said end portion of said wire shield and said ferrule together.

13. The manufacturing method for assembling said high voltage vertical disk ferrule and said wire according to claim 10, wherein said step of soldering, welding, or brazing includes the step of ultrasonic welding said end portion of said wire shield and said ferrule together.

14. A manufacturing method for assembling a high voltage vertical ferrule and a wire, comprising the steps of:

pushing an end portion of a wire shield of said wire into a flared end portion;

inserting said high voltage vertical ferrule over a wire core insulation of said wire, said flared end portion extending substantially perpendicular to a direction along which said ferrule is inserted over said wire core insulation of said wire;

pushing said high voltage vertical ferrule against said flared end portion of said wire shield of said wire;

allowing for the formation of a bunched or an accordion in a portion of said wire shield of the wire substantially located between said vertical disk ferrule and an outer insulation of said wire; and one of soldering, welding, and brazing said flared portion of said end portion of said wire shield and said high voltage vertical ferrule together to form a soldered, welded, or brazed portion.

15. The manufacturing method for assembling said high voltage vertical disk ferrule and said wire according to claim 14, wherein said step of inserting said high voltage vertical disk ferrule over said wire shield of said wire includes the step of positioning said high voltage vertical disk ferrule substantially perpendicular to said wire.

16. The manufacturing method for assembling said high voltage vertical disk ferrule and said wire according to claim 14, further comprising the steps of:

inserting said end portion of said wire into an opening of a connector housing; and contacting said end portion of said wire with a terminal.

17. The manufacturing method for assembling said high voltage disk ferrule and said wire with a connector housing according to claim 16, further comprising the step of contacting said soldered, welded, or brazed portion with a shielding or a grounding of said connector housing.

18. A manufacturing method for assembling a high voltage vertical disk ferrule and a wire, comprising the steps of:

inserting a ferrule over a wire shield of the wire;

pushing an end portion of the wire shield against said ferrule into a flared end portion, said flared end portion extending substantially perpendicular to a direction along which said ferrule is inserted over said wire shield of said wire; and one of soldering welding, and brazing said flared end portion of said wire shield and said ferrule together to form a soldered, welded, or brazed portion, wherein said step of inserting at least one high voltage vertical disk ferrule includes the steps of:

inserting a first high voltage vertical disk ferrule over said wire shield of said wire;

pushing said end portion of said wire shield against said first high voltage vertical disk ferrule or pushing said first high voltage vertical disk ferrule against said end portion of said wire shield;

inserting a second high voltage vertical disk ferrule over a wire core insulation of said wire;

pushing said second high voltage vertical disk ferrule against said end portion of said wire shield; and one of soldering, welding, and brazing said first high voltage vertical disk ferrule and said second high voltage vertical disk ferrule together to form a soldered, welded, or brazed portion;

sandwiching a flared portion of said wire shield of said wire between said first and second high voltage vertical disk ferrules, then soldering, welding, or brazing said first high voltage vertical disk ferrule, said second high voltage vertical disk ferrule, and said flared portion of said wire shield together to form a soldered, welded, or brazed portion; and further comprising the step of allowing the formation of a bunched or an accordion in a portion of said wire shield of said wire substantially located between said first high voltage vertical disk ferrule and an outer insulation of said wire.

* * * * *